United States Patent [19]

Strobel et al.

[11] 4,347,869

[45] Sep. 7, 1982

[54] HYDRAULIC VALVE POSITION CONTROL SYSTEM FOR REGULATING SMOKESTACK EXHAUST PRESSURE

[75] Inventors: Richard A. Strobel; Michael D. Lyons, both of Lexington, Ky.

[73] Assignee: American Standard Inc., Lexington, Ky.

[21] Appl. No.: 103,802

[22] Filed: Dec. 14, 1979

[51] Int. Cl.[3] ..... F16K 37/00; F23N 3/00

[52] U.S. Cl. ..... 137/488; 137/554; 137/599; 431/20; 236/15 C; 91/363 R

[58] Field of Search ..... 137/487.5, 613, 487, 137/599, 488; 431/20, 19; 236/1 G, 15 C

[56] References Cited

U.S. PATENT DOCUMENTS

| | | | |
|---|---|---|---|
| 2,698,717 | 1/1955 | Sisco | 137/488 X |
| 2,938,536 | 5/1960 | Ehrenberg | 137/487.5 |
| 3,015,768 | 1/1962 | Hornfeck et al. | 137/487.5 |
| 3,072,146 | 1/1963 | Gizeski | 137/552 |
| 3,294,146 | 12/1966 | Voorheis | 236/15 C |
| 3,548,865 | 12/1970 | Povinger | 137/487.5 |
| 3,552,428 | 1/1971 | Pemberton | 137/487.5 |
| 3,707,978 | 1/1973 | Volk, Jr. | 137/487.5 |
| 3,726,307 | 4/1973 | Carman et al. | 137/487.5 |
| 3,757,808 | 9/1973 | Peterson et al. | 137/487.5 |
| 3,937,248 | 2/1976 | Hutton | 137/487.5 |
| 4,133,511 | 1/1979 | Hartman et al. | 251/133 |

*Primary Examiner*—A. Michael Chambers

*Attorney, Agent, or Firm*—G. J. Falce

[57] ABSTRACT

A control system for regulating exhaust gas pressure in a furnace smokestack by means of three power cylinder actuated butterfly valves in the smokestack opening. An electronic control circuit provides digital output signals, which operate spool valve devices via which a hydraulic fluid circuit is established to control the power cylinders. In a trim mode control circuit, a first comparator senses a difference between the actual stack pressure and a desired pressure. The comparator output is converted by an analog to digital section to provide the digital output signals for control of a single butterfly valve. A rangefinder mode control circuit includes a second comparator that senses an output from the first comparator in excess of a predetermined value. The second comparator output is also converted by an analog to digital section similar to that of the aforementioned trim mode control circuit to provide digital output signals for controlling a second butterfly valve concurrently with the first butterfly valve to obtain a fast pressure adjustment. A manual mode control circuit similar to the trim and rangefinder mode circuits controls the position of a third butterfly valve irrespective of the stack pressure in order to force a desired change in the stack pressure and thereby cause the first and second butterfly valves to be operated to maintain a desired pressure, as a means of maintaining their operating positions in the median of their operating range.

12 Claims, 2 Drawing Figures

HYDRAULIC VALVE POSITION CONTROL SYSTEM FOR REGULATING SMOKESTACK EXHAUST PRESSURE

BACKGROUND OF THE INVENTION

The present invention is related to the control of exhaust gas pressure in furnace smokestacks by hydraulic valves and particularly to electronic circuitry for operating these hydraulic valves in different control modes.

The high quality production of steel requires close control of furnace exhaust gas pressure. Furnace smokestacks are normally provided with butterfly-type exhaust control valves, which are power-operated to adjust the smokestack opening in order to continuously regulate the furnace exhaust gas pressure. In present practice, the power operation of these valves is by hydraulic-type, servo-positioning cylinders that are located in the smokestack in proximity with the butterfly valves. Such an arrangement has not been entirely satisfactory, due in part to the difficulty encountered in repairing a malfunctioning servo valve, due to its remote location in the smokestack, and due in part to the relative unreliability of servo-type valves when operating in extreme conditions of dirt, as found in a smokestack.

SUMMARY OF THE INVENTION

It is, therefore, an object of the present invention to employ on/off-type hydraulic positioning cylinders to control the smokestack exhaust control valves by means of a closed loop, pressure feedback, electronic control system.

Another object of the invention is to arrange this pressure-regulated control system to compensate for small deviations between the desired and actual smokestack pressure by operating a single exhaust control valve and to compensate for greater deviations by operating two exhaust control valves to obtain faster response.

Still another object is to maintain the exhaust control valves operating in the median of their operating range to obtain maximum response to changes in smokestack pressure.

Yet another object of the invention is to select any one of the exhaust pressure control valves for operation in a trim, rangefinder, or manual adjustment mode.

A final object is to provide an interlock via which all of the exhaust control valves may be selectively set to their full open position in the event of a malfunction.

In carrying out these objectives, there is provided in a furnace smokestack three butterfly-type, exhaust control valves, any one of which may be controlled in a selected one of three different control modes. A mode selector switch is provided to set up any possible mode control combination desired. For example, a manual mode may be selected for any of the three valves, while either one of the remaining two valves is assigned a trim mode and the other is assigned the rangefinder mode. The valve controlled in the trim mode automatically compensates for small changes in the smokestack pressure relative to a desired pressure set by a rheostat. If the smokestack pressure deviation exceeds a certain value, both the trim mode controlled valve and the rangefinder mode controlled valves operate concurrently to adjust the stack pressure. This coarse adjustment of the stack pressure is terminated, as the pressure approaches its set value, by reason of the rangefinder mode controlled valve holding position, as the valve operated in the trim mode continues to make the final fine adjustment of the stack pressure.

The position of the manual mode controlled valve may be manually selected at any time to cause a variation in smokestack pressure in such sense as to force the rangefinder and trim mode controlled valves to move toward a position in their median range of operation to compensate for this forced pressure change in the smokestack. In this way, the rangefinder and trim mode controlled valves may be maintained in their optimum operating range, while controlling the stack pressure.

All three valves may be placed in a full, open position regardless of the stack pressure by means of an interlock switch that cuts out the rangefinder, trim, and manual mode control circuitry.

BRIEF DESCRIPTION OF THE DRAWINGS

Other objects and advantages of the invention will become apparent from the following more detailed explanation when taken in connection with the accompanying drawings wherein.

DESCRIPTION AND OPERATION

Figure 1:
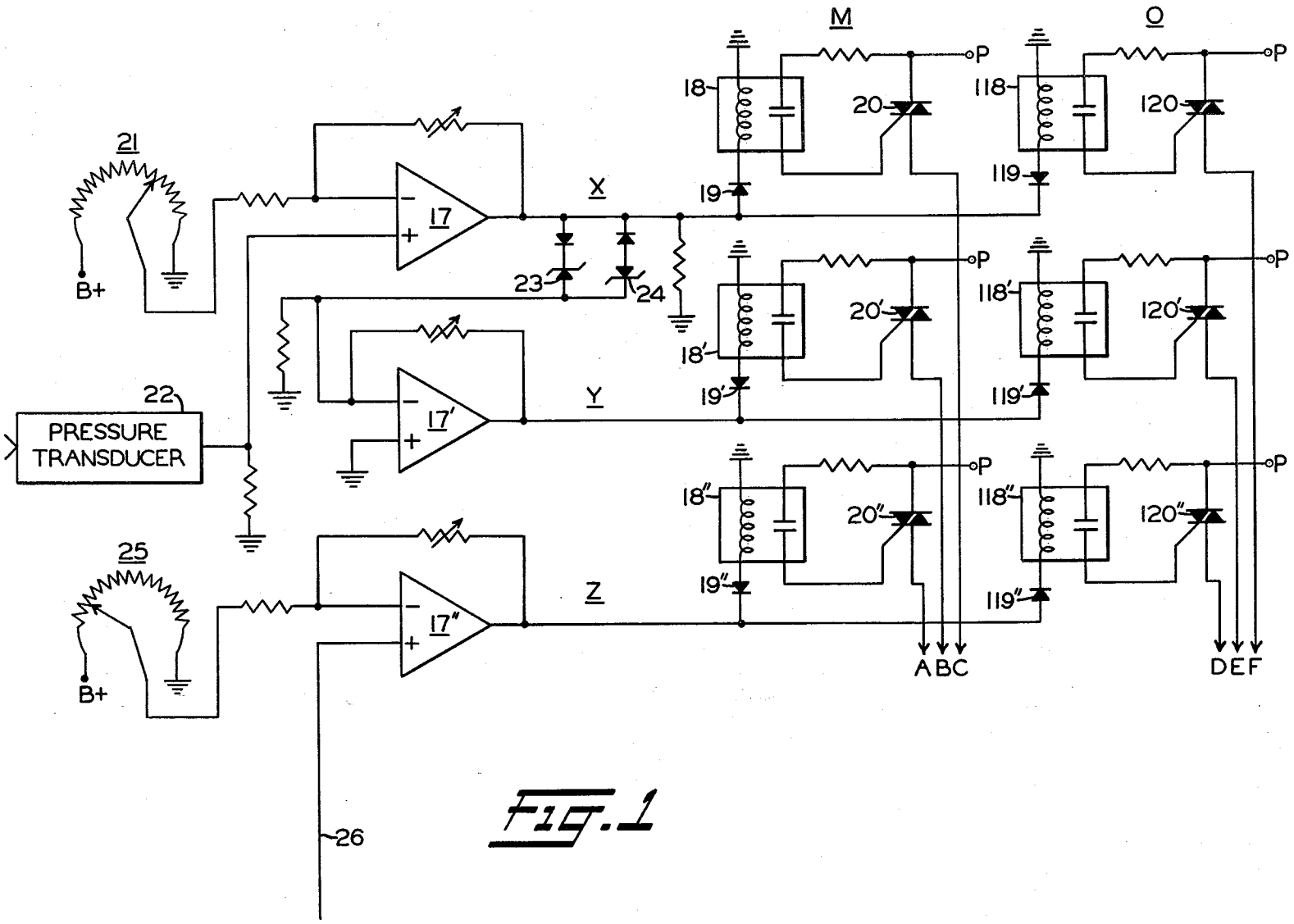
FIG. 1 is a schematic of the electronic control circuit portion of the control system for controlling the smokestack exhaust pressure control valves in the rangefinder, trim, and manual operating modes.
Figure 2:
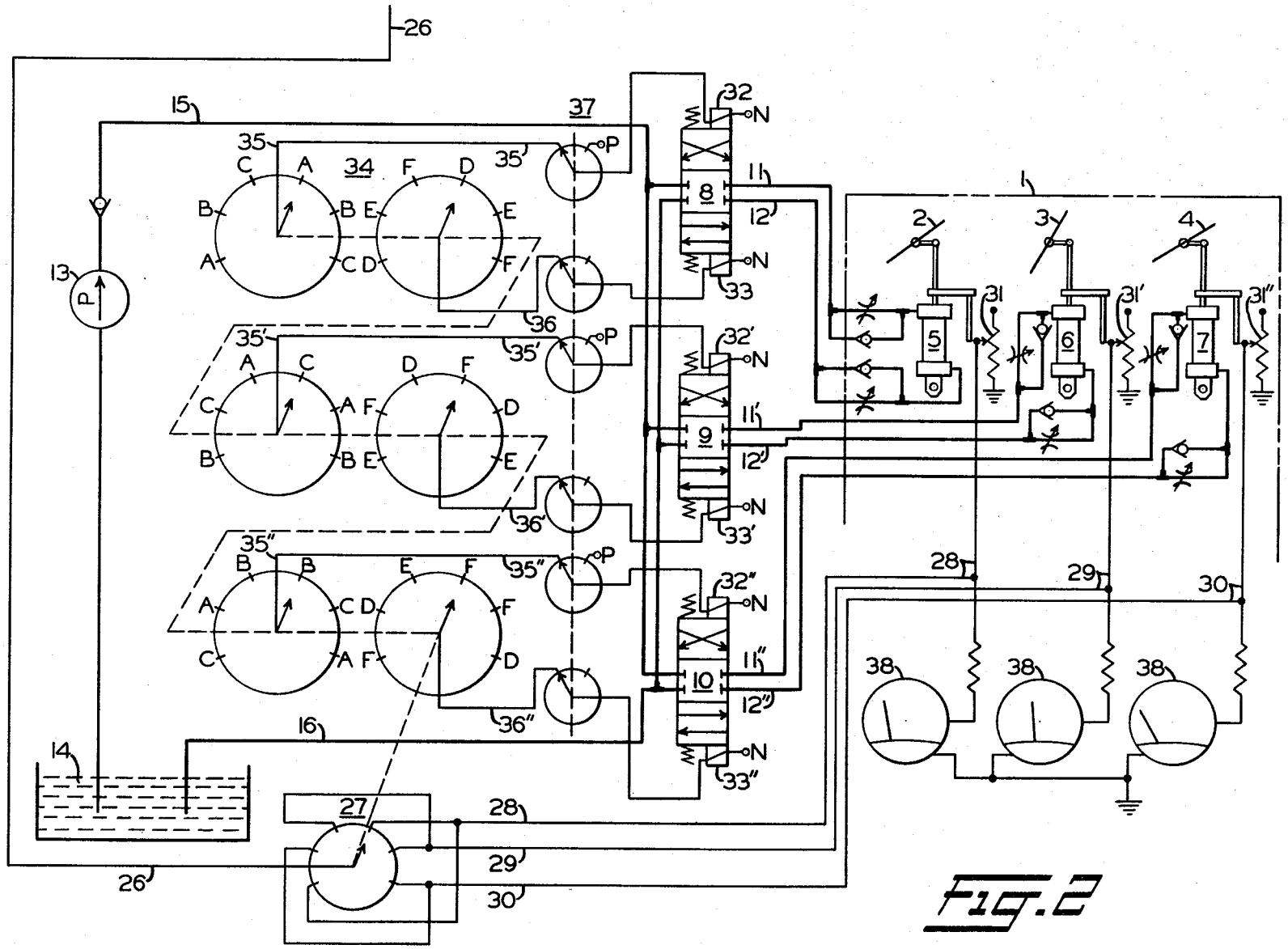
FIG. 2 is a schematic of the actuator portion of the control system including the smokestack exhaust control valve power actuators and the controls therefor.

In accordance with the present invention, a furnace smokestack 1 is arranged with three butterfly-type exhaust control valves 2, 3, and 4 disposed in a horizontal plane within the smokestack to control the smokestack pressure. Each of the valves 2, 3, and 4 is connected to a bi-directional or doubleacting hydraulic power cylinder 5, 6, and 7, respectively, in a manner to be adjustably operated over a full range between open and closed positions, in accordance with the supply and exhaust of hydraulic fluid to the opposite sides of the power cylinders. Control of hydraulic fluid to the power cylinders 5, 6, and 7 is by way of solenoid-operated, three-position, spring-centered spool valve devices 8, 9, and 10, each of which is connected with a respective one of the power cylinders 5, 6, and 7 via control conduits 11, 11', and 11'' and 12, 12', 12''. A pump 13 delivers hydraulic fluid from a reservoir 14 to each spool valve device 8, 9, and 10 via a supply conduit 15, while a return conduit 16 between these spool valves and reservoir 14 completes the hydraulic circuit.

A control logic network comprising a trim mode circuit X having output wires C and F, a rangefinder mode circuit Y having output wires B and E, and a manual mode circuit Z having output wires A and D control the spool valve devices 5, 6, and 7 so as to operate in a particular control mode, as hereinafter explained. The respective control circuits X, Y, and Z include a proportional-type, differential amplifier 17, 17', and 17'' as well as similar digital control sections M and O. Control section M generates control signals at output wires A, B, and C, while control section O generates control signals at output wires D, E, and F. Control section M of the respective trim, rangefinder, and manual control circuits comprises a reed relay 18, 18', and 18'', to which the output of amplifier 17, 17', and 17″ is connected via a diode 19, 19′, and 19″, as well as a triac 20, 20′, and 20″. The gate terminal of these triacs is connected to the output of a respective reed relay switch, the anode is connected to to a source of A.C. power P, and the cathode is connected to a respective one of the aforementioned output wires A, B, and C.

Being similar in construction, like components of control section O of the respective trim, rangefinder, and manual moe circuits are identified by reference numerals differing by a value of 100.

Amplifier 17 of the trim mode circuit X is connected at its negative input terminal to a desired pressure command signal, as provided by selectively setting a rheostat 21. The positive input terminal is connected to a pressure transducer 22 that provides a feedback signal representative of the exhaust gas pressure existing in smokestack 1.

Amplifier 17′ of rangefinder mode circuit Y is connected at its negative input terminal to the output of the trim mode circuit amplifier 17 via a pair of oppositely connected zener diodes 23, 24 and is connected at its positive input terminal to ground to provide a reference signal thereat.

Amplifier 17″ of manual mode circuit Z is connected at its negative input terminal to a rheostat 25, which may be manually set to provide a position command signal, and is connected at its positive input to a wire 26 that provides a feedback signal indicating the actual valve position of whichever one of the butterfly valves 2, 3, and 4 is under manual control. A conventional three-pole, feedback selector switch 27 is connected at its contactor to wire 26, each pole being connected by a respective wire 28, 29, and 30 to the output of a potentiometer 31, 31′, and 31″ associated with a respective power cylinder 5, 6, and 7. These potentiometers are connected to the power cylinder actuating arms in a conventional manner to continuously indicate the positions of butterfly valves 5, 6, and 7. Indicator gages 38 are also connected to the potentiometer outputs to provide a visual indication of the position of butterfly valves 5, 6, and 7. As shown, switch 27 may be connected to switch 34 for rotation therewith, in order to assure that feedback wire 26 is always connected to the potentiometer of whichever butterfly valve is selected for operation under control of the manual mode control circuit Z.

Outputs A, B, and C of control section M are connected to a solenoid 32, 32′, and 32″ of respective spool valve devices 8, 9, and 10, while the outputs D, E, and F of control section O are connected to a solenoid 33, 33′, and 33″ of the respective spool valve devices 8, 9, and 10. These connections are made by way of a mode selector switch device 34, which permits any combination of butterfly valves 2, 3, and 4 to be selected to operate under control of the trim, rangefinder, and manual control circuits X, Y, and Z. Mode selector switch device 34 may take the form of a conventional, six-position, six-pole, rotary wafer switch. Outputs A, B, and C of control section M of the logic control networks are each connected in duplicate to three of the discs of the rotary wafer switch. A contactor of each of these three discs is connected by a wire 35, 35′, and 35″ to the solenoids 32, 32′, and 32″ of spool valves 8, 9, and 10. Outputs D, E, and F of control section O are each connected in duplicate to three different discs of the rotary wafer switch. A contactor of each of these different three discs is connected by a wire 36, 36′, and 36″ to the solenoid 33, 33′, and 33″ of spool valves 8, 9, and 10.

A two-position, six-pole, rotary wafer-type interlock switch 37 is disposed between mode selector switch 34 and spool valves 8, 9, and 10. Three discs of the six-pole switch 37 are connected in wires 35, 35′, and 35″, so as to establish a circuit between these discs of selector switch 34 and spool valve solenoids 32, 32′, and 32″ in automatic position and to interrupt this circuit connection in open position. Concurrently, the other three discs of switch 37 are connected in wires 36, 36′, and 36″ so as to establish a circuit between these discs of selector switch 34 and spool valve solenoids 33, 33′, and 33″ in automatic position and to interrupt this circuit connection in the open position. In this open position, an A.C. power source P is connected to the spool valve solenoids 33, 33′, and 33″ in bypass of the selector switch 34.

Let it now be assumed that mode selector switch 34 is set in the position shown, in which outputs A and D of the manual mode circuit Z are connected by the rotary wafer switch to solenoids 32 and 33, respectively, of spool valve device 8. Likewise, trim mode circuit outputs C and F are connected to solenoids 32′ and 33′ of spool valve device 9, and rangefinder mode circuit outputs B and D are connected to solenoids 32″ and 33″ of spool valve device 10. Let it also be assumed that interlock switch 37 is in the automatic position shown to make the foregoing connections. Being connected to control conduits 11, 12 of spool valve device 8, power cylinder 5, is thus selected to adjust the position of butterfly valve 2 by a manual mode of control. Likewise, control conduits 11′, 12′ connect spool valve device 9 to power cylinder 6, so as to adjust butterfly valve 3 in a trim mode of control, and control conduits 11″, 12″ connect spool valve device 10 to power cylinder 7, so as to adjust butterfly valve 4 in a rangefinder mode of control.

In that butterfly valve 2 is selected, in accordance with the foregoing, to operate in the manual mode, feedback selector switch 27 is positioned, as shown, by rotation of switch 34, to connect output wire 28 of potentiometer 31 to wire 26 leading to the positive or feedback terminal of comparison amplifier 17″ in manual mode circuit 2. Thus, the feedback signal established at the manual mode circuit amplifier 17″ corresponds to the instantaneous position of butterfly valve 2, which is selected for adjustment under manual mode. This feedback signal is compared with the position command provided by rheostat 25 and effective at the negative input terminal of amplifier 17″.

With the controls set up, as above discussed, rheostat 21 may be positioned in accordance with the smokestack exhaust pressure desired to be maintained. Should this exhaust pressure, as monitored by pressure transducer 22, deviate from the desired pressure set by rheostat 21, butterfly valves 3 and 4 will operate automatically to adjust the smokestack pressure to correspond with the desired pressure.

Assuming, for example, that the smokestack pressure exceeds the desired pressure, then the feedback signal from pressure transducer 22 will provide a voltage signal at the positive input terminal of amplifier 17 of trim control circuit X in excess of the voltage signal existing at the amplifier negative input terminal. Amplifier 17 thus produces a positive output signal proportional to the amplifier input differential, in response to which diode 19 becomes conductive to energize reed relay 18 and, accordingly, cause triac 20 to "turn on". The output of triac 20 accordingly produces output signal C of the logic network control section M.

Zener diode 23 is selected to conduct voltages in excess of a preselected, relatively low value to the negative input terminal of amplifier 17' in rangefinder circuit Y, for comparison with ground reference at the positive input terminal. In the event the output signal from amplifier 17 of trim control circuit X exceeds the preselected value sufficient to cause zener diode 23 to conduct, the voltage supplied to the negative input terminal of amplifier 17' will establish an input voltage differential and thus an output voltage of negative polarity proportional to the input voltage differential. Accordingly, diode 19' becomes conductive to connect the output of amplifier 17' to reed relay 18', and in turn cause triac 20' to "turn on". This results in rangefinder control circuit Y producing output signal B concurrently with output signal C from the trim control circuit X.

Signals B and C are connected via mode selector switch 34 and interlock switch 37 to solenoids 32'' and 32', respectively, of spool valve devices 10 and 9. The respective spool valves are positioned to establish the fluid pressure connections, as represented in the lower diagram block. That is, hydraulic fluid in supply conduit 15, which is maintained under pressure by pump 13, is connected by the spool valves 9 and 10 to control conduits 11' and 11'' leading to corresponding ends of power cylinders 6 and 7, while the opposite ends of these power cylinders are connected via control conduits 12' and 12'' and spool valves 9 and 10 to return line 16 and reservoir 14. The resultant hydraulic fluid pressure differential actuates these power cylinders, which operate through linkage with their respective butterfly valves to rotate these valves in a counterclockwise direction, as viewed in the drawing. It will be understood that such counterclockwise rotation of valves 3 and 4 produces a greater smokestack opening, thus reducing the smokestack exhaust pressure (to alleviate the assumed condition of excessive smokestack pressure).

The resultant reduction is smokestack pressure is sensed by pressure transducer 22, which reduces the voltage feedback signal at the positive input terminal of amplifier 17, accordingly decreasing the input voltage differential and thus the proportional output voltage of amplifier 17. When the output voltage of amplifier 17 of trim control circuit X decreases below the predetermined value of zener diode 23, the zener diode becomes nonconducting and the negative input terminal of amplifier 17' of the rangefinder control circuit goes to zero potential. Thus, a voltage differential no longer exists across the input terminals of amplifier 17', which consequently becomes nonconducting, and the signal at output B of rangefinder control circuit Y disappears. In the absence of a signal at output B, solenoid 32'' of spool valve device 10 is deenergized to allow this spool to be spring-returned to its center lap position, in which the hydraulic fluid in control conduits 11'' and 12'' is trapped. This results in the actuating pressure differential of power cylinder 7 balancing out and the butterfly valve 4 holding position. This terminates the rangefinder mode of controlling the smokestack pressure, in which a coarse adjustment of the pressure is obtained by the concurrent operation of valves 3 and 4.

Adjustment of butterfly valve 3 continues to be made under control of the trim circuit X, as above explained, until the feedback signal of the smokestack pressure provided by transducer 22 corresponds to the desired pressure command signal provided by rheostat 21. When this occurs, amplifier 17 of trim control circuit X becomes nonconducting and output signal C disappears. In the absence of output signal C, solenoid 32' of spool valve device 9 is de-energized and this spool valve is also spring-returned to its center lap position, in which the hydraulic fluid in control conduits 11' and 12' is trapped. This results in the actuating pressure differential of power cylinder 6 balancing out and the butterfly valve 3 holding position. This terminates the trim mode of controlling the smokestack pressure, in which a slower final adjustment of the pressure, to the value set by command rheostat 21, is obtained.

In the event that the smokestack pressure should again deviate from the desired value set by rheostat 21 as, for example, by decreasing, amplifier 17 will emit a negative output signal proportional to the amplifier input differential. Being of negative polarity, the amplifier output is blocked by diode 19 and conducted by diode 119 to reed relay 118, which gates triac 120 and thus energizes its output at F. Concurrently, zener diode 24 conducts any of the output voltage of amplifier 17, in excess of a predetermined minimum value, to the negative input terminal of amplifier 17', which accordingly produces an output voltage of positive polarity proportional to the voltage passed by zener diode 24. Diode 19' blocks this positive polarity output of amplifier 17', while diode 117' conducts to energize reed relay 118' and thereby gate triac 120' to energize its output at E.

Outputs E and F in digital control section O of the logic control network are connected via switches 34 and 37 to energize solenoids 33' and 33'' of spool valve devices 9 and 10. These spool valves are, accordingly, shifted from their center lap position to a position represented by the lower diagram block, in which control conduits 11' and 11'' are connected to supply line 15 and control conduits 12' and 12'' are connected to return line 16. Power cylinders 6 and 7 are, consequently, urged in a clockwise direction to position butterfly valves 3 and 4 so as to reduce the area of smokestack 1 that is open to atmosphere and thereby increase the pressure of gas in the smokestack.

As the smokestack pressure approaches the value set by rheostat 21, the rangefinder circuit Y will terminate its output E, by reason of zener diode 24 becoming nonconducting when the correspondingly decreased output of amplifier 17 falls below the zener threshold. Consequently, solenoid 33'' of spool valve device 10 is de-energized and the spool is, accordingly, shifted to its center lap position to trap hydraulic fluid in control conduits 11'' and 12'', whereby power cylinder 7 holds the position of butterfly valve 4 constant, thus terminating the coarse adjustment of the smokestack pressure.

Final adjustment of the smokestack pressure is achieved more slowly by continued closing of the single butterfly valve 6 under control of trim control circuit X. When the smokestack pressure sensed by transducer 22 finally corresponds to the pressure command set by rheostat 21, the negative output of amplifier 17 will completely disappear, causing output F to disappear, solenoid 33' of spool valve 9 to be de-energized and the spool to be shifted to its center lap position, thus causing power cylinder 6 to hold the position of butterfly valve 3 constant. Thus, the deficient smokestack pressure is adjusted to the value set by rheostat 21 initially, by operating both butterfly valves 3 and 4, to obtain a fast response, and subsequently, by operating only a single butterfly valve 3 to obtain slower adjustment to the desired pressure. In this manner, relatively fast response and positive control is obtained without causing the control system to oscillate due to "overshooting".

An additional function of the control system is that of controlling the smokestack pressure independently of the automatic controls, in order to keep the rangefinder and trim control butterfly valves operating in an optimum range and thus assure that these valves have the capability of exerting maximum influence upon the smokestack pressure. This is accomplished through the manual mode control circuit Z.

For example, if during the foregoing range and trim control adjustments of the smokestack pressure, either one of the butterfly valves 3 and 4 reaches or approaches its full open or full closed position, as visually displayed by the respective valve position indicator gages 38, the operator can operate butterfly valve 2 in the manual mode of control, such that the smokestack pressure is varied in such sense as to force the butterfly valves 3 and 4 back toward the median of their operating range under control of the trim and range control circuits in bringing the smokestack pressure into agreement with the desired pressure command set by rheostat 21.

Assuming butterfly valve 3, for instance, has approached a fully closed position during automatic adjustment in correcting the deficiency in smokestack pressure, as explained in the foregoing example, rheostat 25 may be set to reduce the position command signal at the negative input terminal of amplifier 17″ in the manual mode circuit Z. This creates an input differential at amplifier 17″, in response to which a positive polarity output signal is generated proportional to the input differential. Diode 19″ blocks the amplfier output from reed relay 18″, while diode 119″ conducts the amplifier output to reed relay 118″. Reed relay 118″, consequently, picks up its contacts to close the gate circuit to triac 120″ and thereby connect power to output D of the manual mode control circuit. Output D is connected via switches 34 and 37 to energize solenoid 33 of spool valve device 8 which is, accordingly, positioned to establish the circuit connections represented in the lower diagram block. Control conduit 11 is thus connected to supply line 15 and control conduit 12 is connected to return line 16, whereby power cylinder 5 is actuated to rotate butterfly valve 3 in a clockwise direction toward its closed position. In moving toward a closed position, butterfly valve 2 is effective to increase the smokestack pressure.

Potentiometer 31 senses the actual position of butterfly valve 2 and transmits a corresponding voltage signal to the positive input of amplifier 17″ via terminal 28 of feedback selector switch 27 and wire 26. When the input signals at the positive and negative terminals of amplifier 17″ become equal, the amplifier output disappears, reed relay 118″ is de-energized, triac 120″ gates off, and output D of the manual mode control circuit disappears. The resultant absence of an output A or D at the manual mode control circuit Z thus results in spool valve device 8 assuming its center lap position to hold the position of power cylinder 5 and, consequently, butterfly valve 2, in accordance with the setting of rheostat 25.

The resultant increase in smokestack pressure due to the adjustment of butterfly 2 toward its closed position under manual mode control is sensed by transducer 22 which, accordingly, decreases, the pressure feedback signal effective at the positive input terminal of amplifier 17 in trim control circuit X. The resultant input differential causes amplifier 17 to emit a positive polarity output which, as previously explained, has the effect of force adjusting butterfly valve 3 in an opening direction to reset its position in the median range of its adjustment.

In the event it is intended to also adjust the range control butterfly valve 4 toward its median range, rheostat 25 is adjusted to a position sufficient to change the smokestack pressure by a greater amount, that is, an amount sufficient to cause the proportional output of amplifier 17 of trim mode control circuit X to exceed the threshold value of zener diode 23 or 24 and, thereby, establish a signal at the negative input terminal of amplifier 17′ in the rangefinder mode control circuit Y. As previously explained, the output of amplifier 17′ and the polarity of such output will establish control of butterfly valve 4 in such sense as to counteract the smokestack pressure deviation relative to the desired pressure set by rheostat 21 and, thereby, cause butterfly valve 4 to assume a position in the median range of its adjustment.

This manual control of the smokestack pressure to force the automatically-controlled trim and range butterfly valves 3 and 4 to operate in their median range can be accomplished, as described above, during the period these valves 3 and 4 are being adjusted, as well as afterwards, since visual position indicator gages 38 provide a continuous indication of the position of the respective butterfly valves.

Interlock switch 37 may be rotated from its automatic position to its open position when it is desired to set each of the butterfly valves 2, 3, and 4 to their full open position as, for example, when a malfunction of the control circuitry renders the butterfly valves inoperative under automatic control. In open position, switch 37 cuts off the solenoids of spool valve devices 8, 9, and 10 from the control circuit outputs at mode selector switch 34 and connects solenoids 32, 32′, and 32″ of these spool valve devices to a position establishing the connections represented in the upper diagram blocks, wherein control conduits 11, 11′, and 11″ are connected to return line 16 leading to reservoir 14 and control conduits 12, 12′, and 12″ are connected to supply line 15. Each power cylinder 5, 6, and 7 is thus actuated, such as to force their respective butterfly valves 2, 3, and 4 to rotate counterclockwise to the full open position. In this manner, pressure in the smokestack may be exhausted unrestricted to assure that the malfunctioning control circuit does not adversely affect the furnace operation due to excessive smokestack pressure.

If, for any reason, it becomes necessary or desirable to change the mode control circuits to which the respective butterfly valves are connected for control, mode selector switch 34 may be rotated from the position shown to any of the remaining positions available. It will be noted that in each of these positions, the outputs A, B, and C of the digital control section M and the outputs D, E, and F of the digital control section O of the respective mode selector circuits X, Y, and Z are connected in a different configuration in the several rotary wafer discs comprising switch 37, in order to set up the butterfly valves for control in any possible combination of operating modes.

Having now described the invention, what we claim as new and desire to secure by Letters Patent, is:

1. A control system for adjusting a plurality of butterfly valves arranged in a substantially horizontal plane of a furnace smokestack to regulate the stack exhaust pressure, comprising:

(a) a source of hydraulic fluid under pressure;

(b) a hydraulic power cylinder for each said butterfly valve having a double-acting piston and linkage connecting said piston to a respective one of said butterfly valves to effect operation thereof in an opening or closing direction;

(c) a solenoid actuated, three position spool valve device having a first position in which hydraulic fluid is connected from said source to one end and is concurrently exhausted from the other end of said double-acting piston of a respective one of said power cylinders, a second position in which hydraulic fluid is connected from said source to said other end and is concurrently exhausted from said one end of said double-acting piston of a respective one of said power cylinders, and a third position in which said supply and exhaust of hydraulic fluid is terminated;

(d) means for selectively establishing a command signal representative of the desired exhaust pressure in said smokestack;

(e) means for establishing a feedback signal representative of the actual exhaust pressure of said smokestack; and (f) first circuit means operative in response to a difference between said command and feedback signals for operating said spool valve device of said one of said power cylinders to said first or said second position depending upon the sense of said difference between said command and feedback signals, and operative in response to equality between said command and feedback signals for operating said spool valve device of said one power cylinder to said third position, thereby adjusting the degree of opening or closing of said butterfly valve associated with said one of said power cylinders and accordingly providing a fine adjustment of said smokestack exhaust pressure; and (g) second circuit means operative concurrently with said first circuit means in response to said difference between said command and feedback signals in excess of a predetermined amount for operating said spool valve device of another one of said power cylinders to said first or said second position depending upon the sense of said difference between said command and feedback signals, and operative in response to said difference between said command and feedback signals being less than said predetermined amount for operating said spool valve device of said another power cylinder to said third position, thereby adjusting the degree of opening or closing of said butterfly valve associated with said another power cylinder concurrently with said adjustment of said butterfly valve associated with said one power cylinder and accordingly providing a coarse adjustment of said smokestack exhaust pressure.

2. The control system as recited in claim 1, wherein said control system further comprises a third circuit means operative in a manual mode of control to actuate a third one of said butterfly valves to any desired position, thereby varying said smokestack pressure independently of said first and said second ones of said butterfly valves to accordingly maintain the position of said first and second butterfly valves in a median range of operation.

3. The control system as recited in claim 2, wherein said first and second circuit means each comprise:

(a) a differential amplifier having a positive input terminal subject to said feedback signal, a negative input terminal subject to said command signal, and an output terminal having a signal proportional to the difference between the command and feedback signals at said input terminals and of a polarity corresponding in sense to the polarity of the preponderant one of said command and feedback signals;

(b) a first digital control section providing a digital output, when the polarity of said proportional output signal of said differential amplifier in the respective first and second circuit means is in one sense; and (c) a second digital control section providing a digital output signal when the polarity of said proportional output signal of said differential amplifier in the respective first and second circuit means is in a sense opposite said one sense.

4. The control system as recited in claim 3, wherein said means for establishing said command signal and said feedback signal further comprises:

(a) voltage selector means connected to said negative input terminal of said differential amplifier of said first circuit for providing said command signal thereat representing the desired smokestack pressure;

(b) means for providing said feedback signal at said positive input terminal of said differential amplifier of said first circuit representing the actual pressure of said smokestack; and (c) means connected between said output of said differential amplifier of said first control circuit and one of said inputs of said differential amplifier of said second control circuit for providing a signal thereat representing the smokestack pressure deviation from said predetermined amount, the other one of said input terminals of said differential amplifier of said second circuit being connected to ground to provide a reference potential thereat.

5. The control system as recited in claim 3 or 4, wherein said first and second digital control sections each comprise:

(a) a source of electric power;

(b) a gate controlled switch device via which current is conducted from said source of power to provide said output signals;

(c) electromagnetic means for gating said switch device when energized; and (d) diode means so arranged between a respective one of said differential amplifiers and said electromagnetic means of a corresponding one of said first and second digital control sections as to effect energization thereof in response to said differential amplifier output signals of opposite polarity.

6. The control system as recited in claim 3, wherein said third circuit means comprises:

(a) a differential amplifier having a positive input terminal, a negative input terminal, and an output terminal having a signal proportional to the difference between the signals at said input terminals and of a polarity corresponding in sense to the polarity of the preponderant input signal;

(b) a first digital control section providing a digital output signal when the polarity of said proportional output signal of said differential amplifier in said third circuit means is in one sense; and (c) a second digital control section providing a digital output signal when the polarity of said proportional output signal of said differential amplifier of said third circuit means is in a sense opposite said one sense.

7. The control system as recited in claim 6, wherein said means for establishing said command signal and said feedback signal further comprise:

(a) voltage selector means connected to said one of said input terminals of said differential amplifier for providing said signal thereat representing the desired position of said third butterfly valve; and (b) position sensing means for providing said feedback signal at the other one of said input terminals of said differential amplifier representing the actual position of said third butterfly valve.

8. The control system as recited in claim 7, further characterized in that said butterfly valves are each provided with said position sensing means, and further comprising switch means for connecting said position sensing means of any one of said butterfly valves to said other one of said input terminals of said differential amplifier.

9. The control system as recited in claim 6, wherein each said spool valve device comprises:

(a) first and second solenoid operators to actuate said spool valve device to said first and second positions, respectively, when energized; and (b) spring means for actuating said spool valve device to said third position when said first and second solenoid operators are both de-energized.

10. The control system as recited in claim 9, further comprising a six-position, six-pole, six-wafer rotary selector switch, each wafer having an output terminal connected to a different one of said first and second solenoid operators of each said spool valve device, and six input terminals so arranged for connection with respective ones of said digital output signals of said first, second and third circuit means as to provide for selection of any combination of said butterfly valves for control by said first, second, and third circuit means.

11. The control system as recited in claim 10, further comprising a two-position, six-pole, six-wafer rotary interlock switch, each wafer being connected between a different one of said waters of said selector switch and the corresponding one of said solenoid operators, so as to make the circuit therebetween in a first position and to interrupt the circuit in a second position, said interlock switch in said second position further connecting a source of power to one of said first and second solenoid operators of each said spool valve device, so as to actuate each said power cylinder in such sense as to effect operation of each said butterfly valve in an opening direction.

12. The control system as recited in claim 1, further comprising means for selectively switching the connection of any of said circuit means to any one of said butterfly valves.

* * * * *

UNITED STATES PATENT AND TRADEMARK OFFICE

CERTIFICATE OF CORRECTION

PATENT NO. : 4,347,869

DATED : September 7, 1982

INVENTOR(S) : Richard A. Strobel & Michael D. Lyons

It is certified that error appears in the above-identified patent and that said Letters Patent are hereby corrected as shown below:

Column 12, line 17, delete "waters" and insert --wafers--

Signed and Sealed this

*Twenty-fourth* Day of *May 1983*

[SEAL]

*Attest:*

DONALD J. QUIGG

*Attesting Officer*

*Acting Commissioner of Patents and Trademarks*